US010576435B2

(12) United States Patent
Kaufmann

(10) Patent No.: US 10,576,435 B2
(45) Date of Patent: Mar. 3, 2020

(54) DISPERSION TOOL, DISPERSION DEVICE AND DISPERSION ASSEMBLY

(71) Applicant: IKA-Werke GmbH & Co. KG, Staufen (DE)

(72) Inventor: Axel Kaufmann, Neuenburg (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 131 days.

(21) Appl. No.: 15/740,161

(22) PCT Filed: Jul. 1, 2016

(86) PCT No.: PCT/EP2016/001132
§ 371 (c)(1),
(2) Date: Dec. 27, 2017

(87) PCT Pub. No.: WO2017/001059
PCT Pub. Date: Jan. 5, 2017

(65) Prior Publication Data

US 2018/0311626 A1 Nov. 1, 2018

(30) Foreign Application Priority Data

Jul. 1, 2015 (DE) ..... 10 2015 008 482

(51) Int. Cl.
*B01F 7/00* (2006.01)
*B01F 13/00* (2006.01)
(Continued)

(52) U.S. Cl.
CPC ..... *B01F 7/00716* (2013.01); *B01F 7/00033* (2013.01); *B01F 7/00725* (2013.01); *B01F 13/002* (2013.01); *B01F 13/0827* (2013.01); *B01F 13/0863* (2013.01); *B01F 15/00012* (2013.01); *B01F 15/0022* (2013.01);
(Continued)

(58) Field of Classification Search
CPC ..... B01F 13/002; B01F 13/0827; B01F 13/0863; B01F 15/00012; B01F 15/00162; B01F 7/00716; B01F 7/00725
See application file for complete search history.

(56) References Cited

U.S. PATENT DOCUMENTS 3,787,185 A * 1/1974 Rohrbaugh ..... G01N 35/025 422/64
4,704,035 A * 11/1987 Kowalczyk ..... B01F 15/00207 366/142
(Continued)

FOREIGN PATENT DOCUMENTS

WO 03/086598 A1 10/2003

OTHER PUBLICATIONS

International Search Report for corresponding PCT Application No. PCT/EP2016/001132 dated Apr. 1, 2017.

*Primary Examiner* — Tony G Soohoo
(74) *Attorney, Agent, or Firm* — Budzyn IP Law, LLC

(57) ABSTRACT

The invention relates to a dispersion tool (4) that can be cleaned more easily. For this purpose, the dispersion rotor (8) is arranged on the dispersion tool (4) axially moveable between the working position in the shaft tube (5) and the cleaning position outside the shaft tube (5), the dispersion rotor (8), in the cleaning position, being preferably completely arranged outside the shaft tube (5) and therefore being more easily cleanable.

25 Claims, 6 Drawing Sheets

Figure 1:
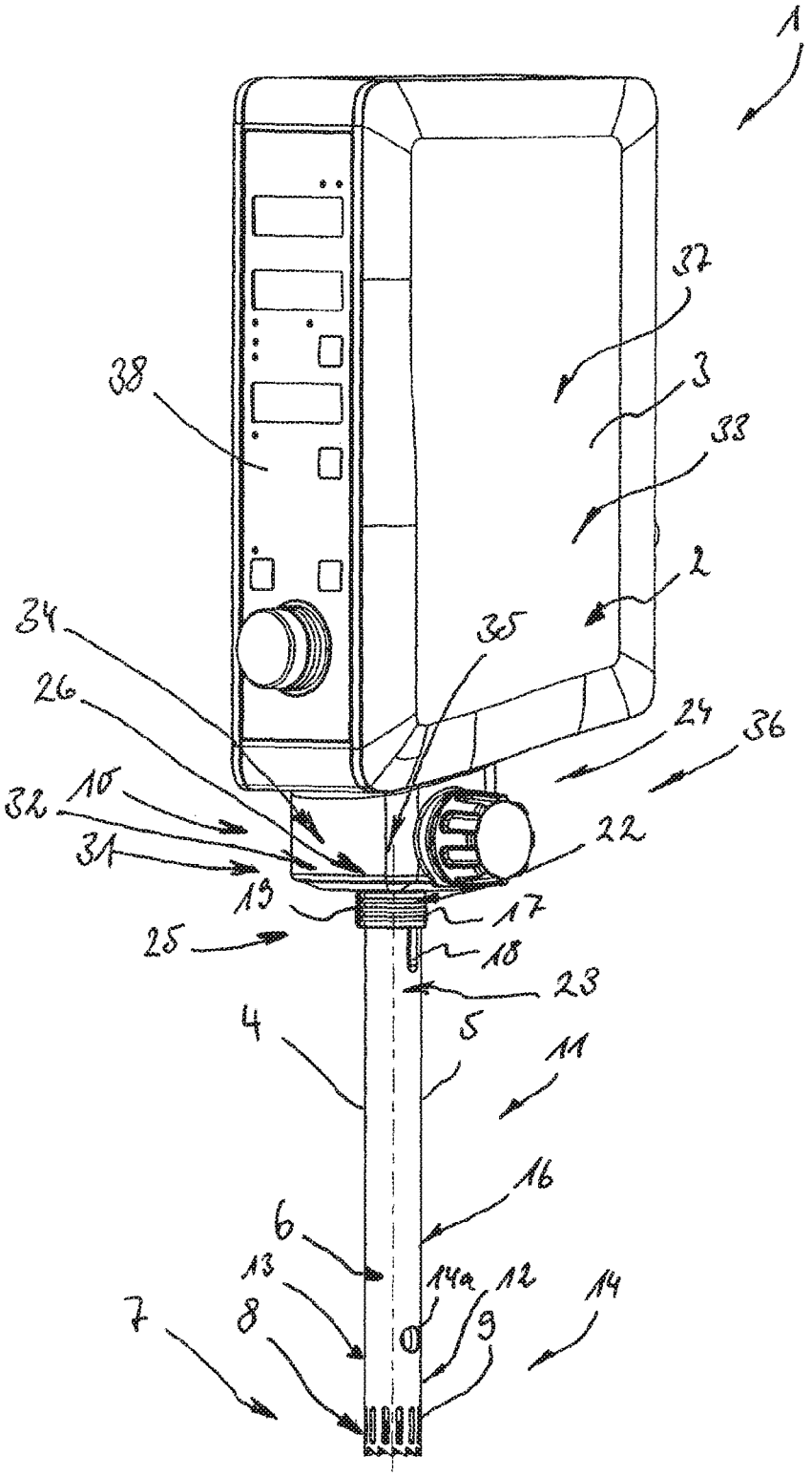

(51) Int. Cl.
*B01F 15/00* (2006.01)
*B01F 15/06* (2006.01)
*B01F 13/08* (2006.01)

(52) U.S. Cl.
CPC .. *B01F 15/00025* (2013.01); *B01F 15/00162* (2013.01); *B01F 15/00175* (2013.01); *B01F 15/00318* (2013.01); *B01F 15/066* (2013.01); *B01F 2015/062* (2013.01)

(56) References Cited

U.S. PATENT DOCUMENTS 4,962,495 A * 10/1990 Gibbons ..... G01K 1/024 340/870.29
5,267,790 A * 12/1993 Sutherland ..... B01F 7/161 366/145
5,589,649 A * 12/1996 Brinker ..... B01L 7/00 219/385
8,903,673 B2 * 12/2014 Brinker ..... G01N 13/00 702/108
9,545,608 B2 * 1/2017 Kaufmann ..... B01F 7/008
9,610,553 B2 * 4/2017 Goodson ..... B01F 13/0001
9,662,620 B2 * 5/2017 Eble ..... B01F 15/0035
9,731,254 B2 * 8/2017 Gunia ..... B01F 3/0853
9,826,855 B2 * 11/2017 Wu ..... A47J 27/10
10,105,665 B2 * 10/2018 Goodson ..... B01F 15/00389
10,238,234 B2 * 3/2019 Lee ..... A47J 36/32
2006/0239113 A1 * 10/2006 Harris ..... A47J 43/0705 366/129
2010/0039883 A1 * 2/2010 Foltyn ..... B01F 7/1605 366/142
2012/0018552 A1 1/2012 Lameiro Vilarino et al.
2012/0189746 A1 * 7/2012 DeLong ..... A47J 36/165 426/231
2013/0101982 A1 * 4/2013 Goodwin ..... B01F 7/00691 435/3
2016/0007801 A1 * 1/2016 Bressner ..... A47J 31/4403 241/86
2016/0151751 A1 * 6/2016 Eble ..... B01F 13/0818 366/146
2016/0290981 A1 * 10/2016 Brinker ..... G01N 21/8507
2017/0089768 A1 * 3/2017 Wu ..... A23L 5/13
2018/0160841 A1 * 6/2018 Wu ..... H05B 3/80
2018/0185798 A1 * 7/2018 Kaufmann ..... B01F 7/00725
2018/0311626 A1 * 11/2018 Kaufmann ..... B01F 7/00033

* cited by examiner

DISPERSION TOOL, DISPERSION DEVICE AND DISPERSION ASSEMBLY

The invention relates to a dispersion tool with a shaft tube and a rotor shaft mounted so as to be rotatable in the shaft tube, wherein a dispersion rotor is arranged on a free end of the dispersion tool, farthest from a power unit in the operating position, which dispersion rotor is drivable with the aid of the rotor shaft and is at least partly surrounded by the shaft tube.

The invention further relates to a dispersion device with a drive unit having a power unit and with a dispersion tool and a dispersion assembly with a dispersion device and with at least two exchangeable dispersion tools.

Dispersion tools, dispersion devices, and even dispersion assemblies are known from the prior art in various embodiments. Since the dispersion tools come into contact with a medium that is to be dispersed when they are used, it is typically necessary to clean the dispersion tools from time to time. In order to clean them, the dispersion tools known previously from the prior art must be disassembled into their individual components so that they can be cleaned with the requisite thoroughness.

The object of the invention is to create a dispersion tool, a dispersion device and a dispersion assembly of the type described in the introduction, with which cleaning of the dispersion tool is simplified.

This object is solved for the dispersion tool defined in the introduction by the means and features of claim 1 and in particular solved by the fact that the dispersion rotor is arranged on the dispersion tool so as to be displaceable axially between a working position inside the shaft tube and a cleaning position outside the shaft tool. This makes it possible to displace the dispersion rotor axially from its working position inside the shaft tube into its cleaning position outside the shaft tube when the dispersion tool and particularly the dispersion rotor are to be cleaned. Thus, a dispersion tool is created that can be cleaned without having to be dismantled.

In an advantageous embodiment of the dispersion tool according to the invention, it may be provided that the dispersion tool has a cleaning limit stop which defines the cleaning position of the dispersion rotor. This can facilitate a displacement of the dispersion rotor into the cleaning position.

In this context, it may be particularly advantageous if the dispersion rotor is mounted so as to be axially displaceable inside the shaft tube, particularly axially displaceable between a working limit stop that defines the working position of the dispersion rotor and a cleaning limit stop that defines the cleaning position of the dispersion rotor, such as the cleaning limit stop described previously, for example. In this way, the dispersion rotor may be moved reliably from its working position into the cleaning position and vice versa.

Alternatively or in addition thereto, it may also be provided that the rotor shaft is mounted so as to be axially displaceable inside the shaft tube, particularly axially displaceable between a working limit stop that defines the working position of the dispersion rotor and a cleaning limit stop that defines the cleaning position of the dispersion rotor, such as the cleaning limit stop described previously, for example. This is particularly advantageous if the dispersion rotor is attached integrally to the rotor shaft, as will usually be the case. In addition, a part of the rotor shaft, which may possible come into contact with the medium that is to be dispersed, may thus be cleaned particularly easily.

It may also be possible with the aid of the working limit stop described previously and the counterstop to prevent the rotor shaft and/or dispersion rotor from slipping out of the shaft tube unintentionally.

It may be provided that the dispersion rotor and/or rotor shaft is/are mounted so as to be rotatable in the shaft tube of the dispersion tool by means of a radial bearing, particularly by means of a radial plain bearing. In this way, it would be possible to reach the necessary rotating speed of the dispersion rotor and therewith of the rotor shaft without generating excessive heat or even vibration.

In addition or alternatively thereto, it may be provided that a distance between the working position and the cleaning position and/or an axial advance of the dispersion rotor and/or the rotor shaft from the working position into the cleaning position are at least as large as an axial dimension of the radial bearing. In this way, it may be ensured that when the dispersion rotor or the rotor shaft is shifted from the working position into the cleaning position the radial bearing of the dispersion tool is pushed apart or disassembled. This makes it possible to clean the radial bearing as well, and to reliably remove the residue of any medium still remaining in the radial bearing.

In one particularly important embodiment of the dispersion tool according to the invention, it may be provided that a flushing gap is present between a bearing inner surface of the radial bearing and a bearing outer surface of the radial bearing and/or an inner surface of the shaft tube, particularly when the dispersion rotor has been displaced into the cleaning position. This flushing gap may further simplify cleaning of the dispersion tool, particularly the radial bearing, and also the dispersion rotor.

In this context, it may further be advantageous if the dispersion tool includes a flushing opening, through which for example a flushing fluid may be introduced into the region of the radial bearing and in particular into the region of the flushing gap from outside, so that the dispersion tool may be cleaned more easily still.

In order to define the cleaning position of the dispersion rotor and therewith also the rotor shaft, it may be expedient if a cleaning limit stop—the one described previously for example—is formed inside the shaft tube and if the rotor shaft has a shaft shoulder that is constructed to match the cleaning limit stop. In such a case, an internal diameter of the shaft tube that is delimited by the cleaning limit stop may be smaller than an external diameter of the shaft shoulder.

In addition or alternatively thereto, it may also be provided that a distance between the dispersion rotor and a shaft shoulder of the rotor shaft, for example the shaft shoulder described previously, may be at least as large as, preferably larger than a distance between the free end of the shaft tube and a cleaning limit stop, for example the cleaning limit stop described previously—at least when said cleaning limit stop is in a position in which the dispersion rotor has been displaced into the cleaning position. In this way, it is possible to displace the dispersion rotor from its working position into its cleaning position far enough for the dispersion rotor to protrude completely out of the free end of the shaft tube and can thus be cleaned particularly easily.

In other words, therefore, this therefore means that the distance between the cleaning position and the working position of the rotor is at least as large as an axial dimension of the dispersion rotor, particularly if the rotor is arranged terminally in the free end of the shaft tube, flush with the free end of the shaft tube.

In order to be able to move the dispersion rotor out of its working position and into the cleaning position, it may be advantageous if the dispersion tool is equipped with an actuating element arranged on an external side of the shaft tube, which is connected to the dispersion rotor and/or rotor shaft in such manner that the dispersion rotor and/or rotor shaft is displaceable between the working position and the cleaning position by means of the actuating element. This enables the dispersion rotor and/or rotor shaft to be moved back and forth between the working position and the cleaning position without the aid of a tool.

It may further be provided that a cleaning limit stop defining the cleaning position of the dispersion rotor, for example the cleaning limit stop described previously, is conformed on the actuating element. In this way, the actuating element may fulfil a dual function, and not only effect a shift of the dispersion rotor into the cleaning position, but also limit the travel path of the dispersion rotor.

In one embodiment of the dispersion tool, it may be provided that the previously described actuating element comprises a slider guided in a slot that is arranged and extends axially in the shaft tube. In such a case, the slider may include a pin which protrudes through the slot and into the shaft tube. This pin may clasp behind at least a pin shaft shoulder of the rotor shaft to move the dispersion rotor between the working position and the cleaning position in at least one direction of movement of the dispersion rotor and/or rotor shaft.

A practical embodiment of the dispersion tool according to the invention may provide that the actuating element has a magnetic coupling element. In such a case, this magnetic coupling element may be configured to connect, particularly couple magnetically, the actuating element with the dispersion rotor and/or rotor shaft of the dispersion tool. Thus, in the connected or coupled state, when the actuating element is displaced, the dispersion rotor and/or rotor shaft may also be displaced between the working position and the cleaning position. In this way, a dispersion tool with an actuating element is created in which the actuating element and the dispersion rotor and/or rotor shaft are connected contactlessly, that is to say magnetically coupled. This may be advantageous particularly for purposes of cleaning or generally maintaining the dispersion tool, because with a contactless coupling between the actuating element and the displaceable dispersion rotor and/or rotor shaft it is possible to avoid joints that are difficult to clean, undercuts or relatively complex geometries of such kind.

In order to be able to provide the magnetic coupling between the actuating element and the dispersion rotor and/or rotor shaft, it may be practical if the magnetic coupling element includes or comprises at least one magnet. In such a case, said magnet may be a permanent magnet and/or an electromagnet. In general, however, it is also conceivable that the magnetic coupling element comprises both a permanent magnet and an electromagnet. In this context, it may also be advantageous if the dispersion rotor and/or rotor shaft has/have a countercoupling element. The magnet of the coupling element may then be coupled magnetically with this countercoupling element. It should be noted that the countercoupling element may quite generally be a region of the dispersion rotor and/or rotor shaft which creates magnetic interactions with the at least one magnet of the coupling element by virtue of the material from which it is made. For example, the countercoupling element may be made from a magnetic material, in particular a ferromagnetic metal, which generates a magnet field itself or may be attracted magnetically by the magnet of the coupling element.

If the actuating element is displaceable between a first detent point associated with the working position of the dispersion rotor and a second detent point associated with the cleaning position of the dispersion rotor on the shaft tube, particularly in the longitudinal direction of the shaft tube, the actuating element and therewith also the dispersion rotor may be retained in locked manner in both the cleaning position and the working position by engagement of the actuating element in the respective detent points.

In this context, it may also be advantageous if an axial dimension of the slot is at least as large as the a distance between the working position and the cleaning position of the dispersion rotor.

It may further be advantageous the dispersion tool is equipped with a coupling on a power-unit side end of the drive unit closest to the power unit in the operating position to enable detachable connection with a drive unit of a dispersion device and/or transmission of torques from a drive unit to the rotor shaft. This coupling may be constructed to be compatible with a countercoupling formed on the drive unit, so that it is able to cooperate with it. In this case, the coupling is preferably arranged on the rotor shaft.

In a particularly advantageous embodiment of the dispersion tool, it may also be provided that the power-unit side end of the rotor shaft of the dispersion tool farthest from the dispersion rotor is magnetic and/or ferromagnetic. For this purpose, the power-unit side end of the rotor shaft may be made from a ferromagnetic material, ferromagnetic stainless steel for example, or may be covered with a coating of ferromagnetic material. In this way, it is possible for the rotor shaft to be connected magnetically to a drive unit, particularly a drive shaft of a drive unit in an operating position. Axial forces acting on the rotor shaft, which in the dispersion tools known from the prior art typically have to be dissipated by axial bearings may be absorbed via the magnetic coupling of the rotor shaft with the drive unit and/or the output shaft of the power unit. Thus, a dispersion tool may be created in which an axial support for the rotor shaft by means of a separate axial bearing is unnecessary.

In order to be able to monitor parameters of the medium that is to be dispersed, it may also be advantageous if at least one sensor, particular a temperature sensor and/or a PH-value sensor and/or a pressure sensor is arranged on the dispersion tool, preferably at or adjacent to the free end of the shaft tube.

If the dispersion tool is equipped with a transponder on which specific data for the dispersion tool can be and/or is stored, for example operating data of the dispersion tool, and/or data received from a sensor, for example the previously described at least one sensor on the dispersion tool, and/or data transmitted to the transponder by a transceiver unit, the dispersion tool may be blocked from further use after a certain operating period, for example.

It is thus also possible to store for example a maximum permissible rotating speed for the dispersion tool on the transponder, which is then complied with by a drive unit which is able to read said stored data, as the maximum permissible rotating speed, at which it then drives the dispersion tool.

In this case, the transponder may preferably be a writable transponder. As a rule, such transponders are RFID chips that include a data memory.

In a further particularly important embodiment of the dispersion tool, it may also be provided that a sensor for transmitting measurement data, for example the at least one sensor described previously, is connectible to a drive unit of a dispersion device and/or is connectible or connected, particularly connected by a cable, to a transponder, for example the previously described transponder of the dispersion tool. In such case, the transponder may include an electronic evaluation unit for processing measurement received from the at least one sensor, and may itself be configured for the wireless transmission of measurement data to a drive unit of a dispersion device, particularly a transmitter/receiver unit of such a dispersion device. In this way it is possible to transmit data that is stored on the transponder of the dispersion tool to a drive unit wirelessly and thus for example control and/or regulate a dispersion process on the basis of said data.

In such case, the transmitted data may be data specific to the dispersion tool, for example, or it may also be data that has been captured by the at least one sensor of the dispersion tool, that is to say essentially relating to parameters of the medium that is to be dispersed.

It may further be provided that the dispersion tool or at least an element of the dispersion tool that comes into contact with the medium to be dispersed during use of the dispersion tool is furnished with a non-stick coating. Such non-stick coatings are also called easy-to-clean coatings. Non-stick coatings enable particularly easy cleaning of the dispersion tool, or at least of the elements of the dispersion tool that come into contact with the medium to be dispersed during use. This is helpful because any dirt particles are stick less readily to the elements or parts of the dispersion tool coated in this way and can therefore be removed more easily, typically washed off. In this context, non-stick coatings may particularly be employed that lower a surface energy of the coated element or dispersion tool and so help to prevent adhesion. Coatings that are suitable for this may consist of carbon, amorphous carbon, diamantine carbon, diamond-like carbon (DLC) and/or also diamond. Particularly if elements of the dispersion tool that are made of metal are furnished with coatings consisting of carbon or amorphous carbon or diamantine carbon or DLC or diamond, this may both make cleaning the coated parts easier and result in greater stability of the coated elements of the dispersion tool.

In order to increase the stability of the dispersion tool or of certain elements thereof, coatings may be used that have greater hardness than uncoated stainless steel. Suitable coatings may consist of carbon, amorphous carbon, diamantine carbon, diamond-like carbon (DLC) or even diamond. Coatings with over 1000 HV (Vickers hardness) are particularly well suited for this. The aforementioned coatings may endow the coated elements or components of the dispersion tool with increased chemical resistance. It may be particularly advantageous to furnish the dispersion rotor and/or the rotor shaft and/or a stator of the dispersion tool opposite which the dispersion rotor turns when the dispersion tool is in use, with a coating of carbon and/or amorphous carbon and/or diamantine carbon and/or DLC and/or diamond. In this way, surfaces of the elements which may possibly be exposed to the greatest stresses when the dispersion tool is in operation may be furnished with coatings that have the desired properties, that is to say for example that are particularly easily cleanable and/or have particularly high resistance to wear and thus increase the durability of the dispersion tool.

With the dispersion device defined in the introduction, the object is solved by the means and features of claim 19 and in particular is solved in that the dispersion tool is a dispersion tool according to any one of claims 1 to 18.

In this context, it may be particularly practical if the dispersion tool is detachably connectible or connected in the operating position to the dispersion device. Additionally or alternatively thereto, it may also be provided that the dispersion device has a countercoupling constructed to be compatible with a coupling, for example the previously described coupling of the dispersion tool, which countercoupling is in particular configured to transmit torques from the power unit to the rotor shaft.

In addition or alternatively thereto, it is possible that a working limit stop that defines the working position of the dispersion rotor and/or rotor shaft is conformed on the dispersion device. This working limit stop may then limit the travel path of the dispersion rotor and/or rotor shaft inside the shaft tube of the dispersion tool on one side when the dispersion tool is connected to the dispersion device.

In order to fully exploit the advantages of the dispersion tool according to the invention described in the preceding text, it may be particularly expedient if the drive unit has a permanent magnet on a countercoupling, particularly the aforementioned countercoupling of the drive unit for the rotor shaft for example, to create a magnetic coupling between the drive unit and the rotor shaft, with which a magnetic power-unit side end of the rotor shaft, for example the aforementioned magnetic power-unit side end of the rotor shaft is magnetically coupled and/or connected in the operating position. In this way, a dispersion device may be connected to a dispersion tool and the dispersion tool may be operated without having to provide a separate axial bearing to support the rotor shaft.

If a bayonet-style tool coupling is provided between the dispersion tool and to drive unit for detachably connecting the dispersion tool to the drive unit, the dispersion tool may be connected simply and reliably to the dispersion device.

In this context, it may be expedient if a vertex between a lengthwise slot and a transverse slot of a guide for the bayonet-style tool coupling is arranged or formed such that a magnetic power-unit side end of the rotor shaft, for example the aforementioned magnetic power-unit side end of the rotor shaft comes close enough to a magnet or permanent magnet, for example the aforementioned magnet or permanent magnet in the operating position so that a magnetic coupling, for example the aforementioned magnetic coupling, is created between the drive unit or the rotor shaft when the bayonet-style tool coupling is closed.

In this way, it may be ensured that when the dispersion tool is properly coupled to the dispersion device the magnetic power-unit side end of the rotor shaft advances into the effective range of the permanent magnet on the drive unit and the magnetic coupling is created.

At this point, it should be noted that with the previously described dispersion tool according to the invention it may also be provided that the tool has a bayonet coupling element independently of the dispersion device, which element is configured to enable detachable connection with a bayonet countercoupling element on the dispersion device.

If the dispersion device, particularly the power unit of the dispersion device is equipped with a transmitter/receiver unit that is configured to read from and/or write to a transponder, for example the aforementioned transponder of the dispersion tool, the drive unit may be operated on the basis of the data read out and accordingly a dispersion process may be performed on the basis of this data.

Additionally or alternatively thereto, it may be provided that the drive unit is configured on the basis of data that is storable or stored on a transponder, for example on the aforementioned transponder, for identifying a dispersion tool, for example the dispersion tool described in detail previously. Thus it is possible to enable dispersion tools that are connected to the dispersion device to be identified by the drive unit and to operate the identified dispersion tools with the dispersion programs stored in the drive unit and approved for the corresponding dispersion tools.

It may be particularly expedient if the dispersion device, in particular the drive unit is equipped with a control and/or regulating unit that is connected to the power unit and to a transmitting/receiving unit, for example the aforementioned transmitting/receiving unit, with which the power unit may be controlled and/or regulated on the basis of data sent by the transmitting/receiving unit to the control and/or regulating unit. In this way, dispersion processes may be controlled or regulated on the basis of various data, for example parameters specific to the dispersion tool or also parameters that are captured by a sensor, for example the aforementioned at least one sensor of the dispersion tool.

In order to extend the scope of function of the dispersion device, it may further be provided that the dispersion device is equipped with a temperature control device to control the temperature of the medium to be dispersed and/or is connectible therewith or connected therewith in the operating position. In such case, the temperature control device may preferably be able to be controlled or regulated on the basis of a sensor, for example the aforementioned at least one sensor and/or data transmitted by a transponder, for example the aforementioned transponder, in particular by means of a control and/or regulating unit, for example the aforementioned control and/or regulating unit of the dispersion device.

With the dispersion assembly described in the introduction, the object is solved by the features described herein.

Figure 2:
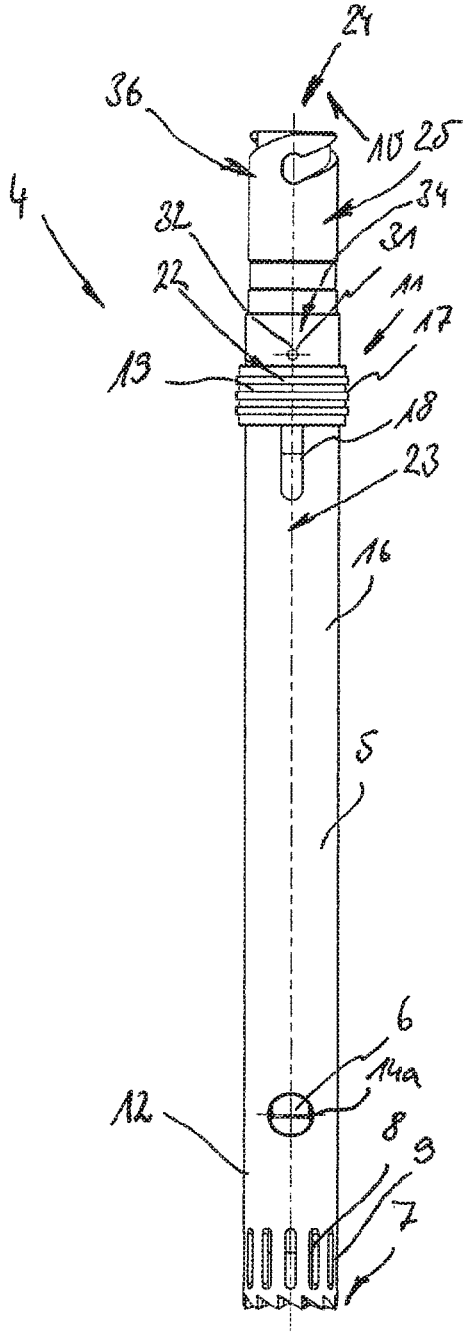
Figure 3:
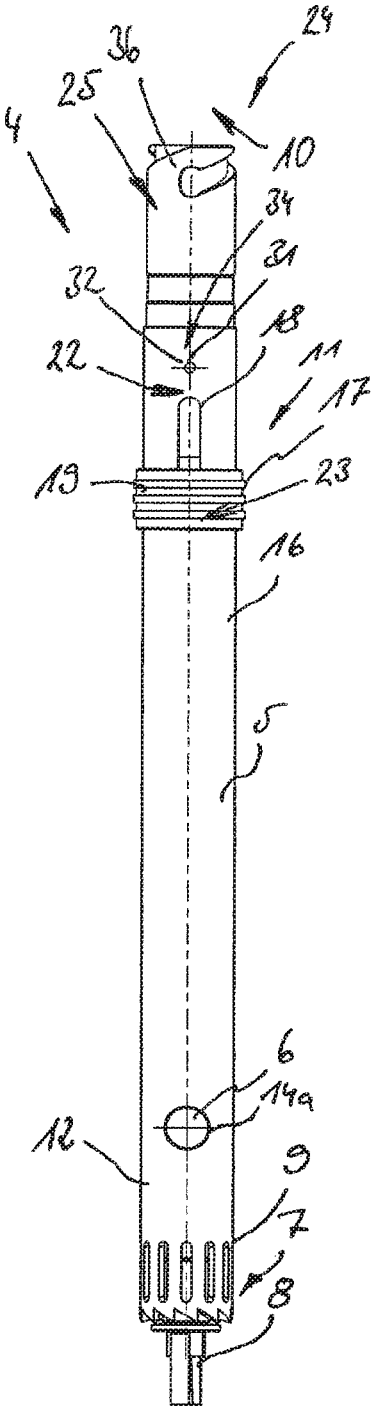
Figure 4:
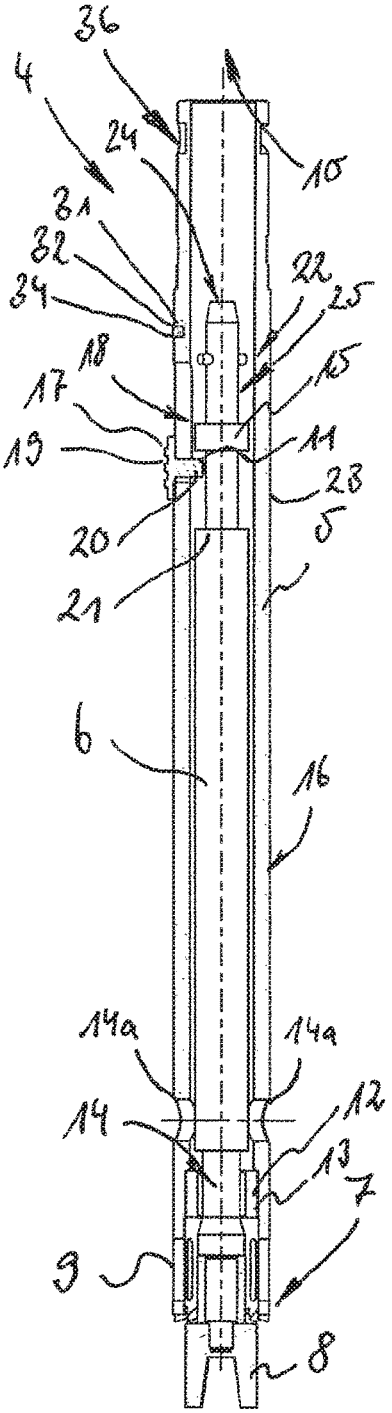
Figure 5:
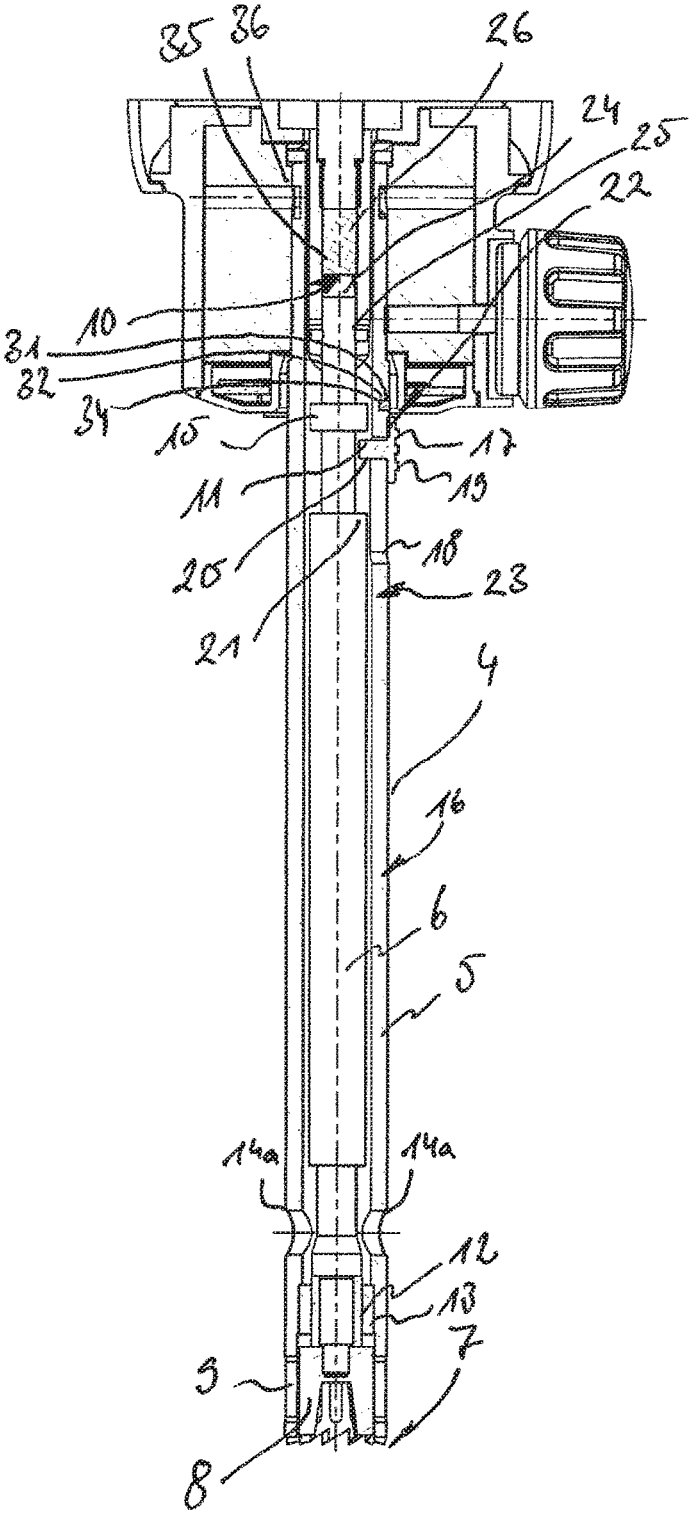
Figure 6:
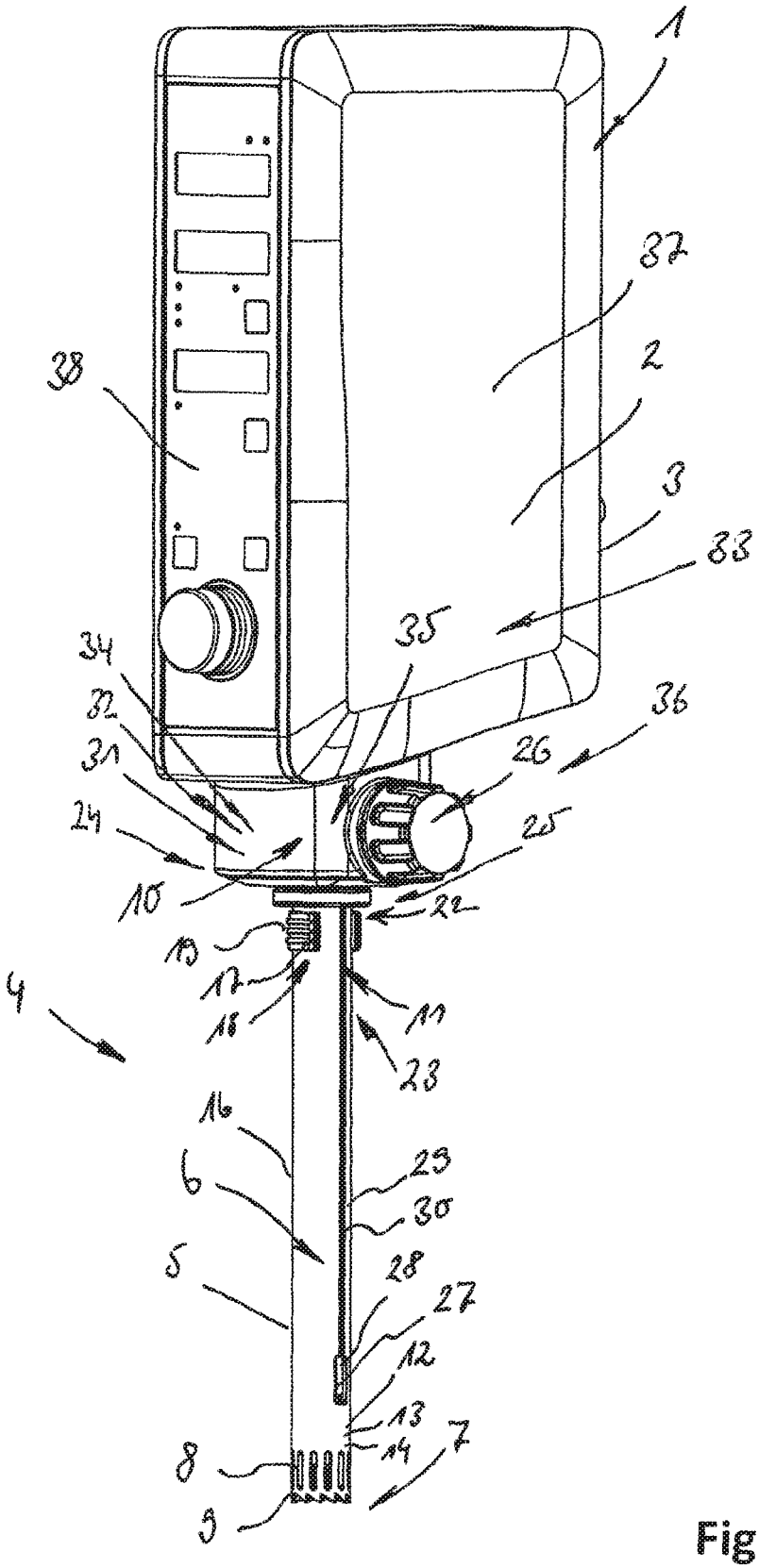
Figure 7:
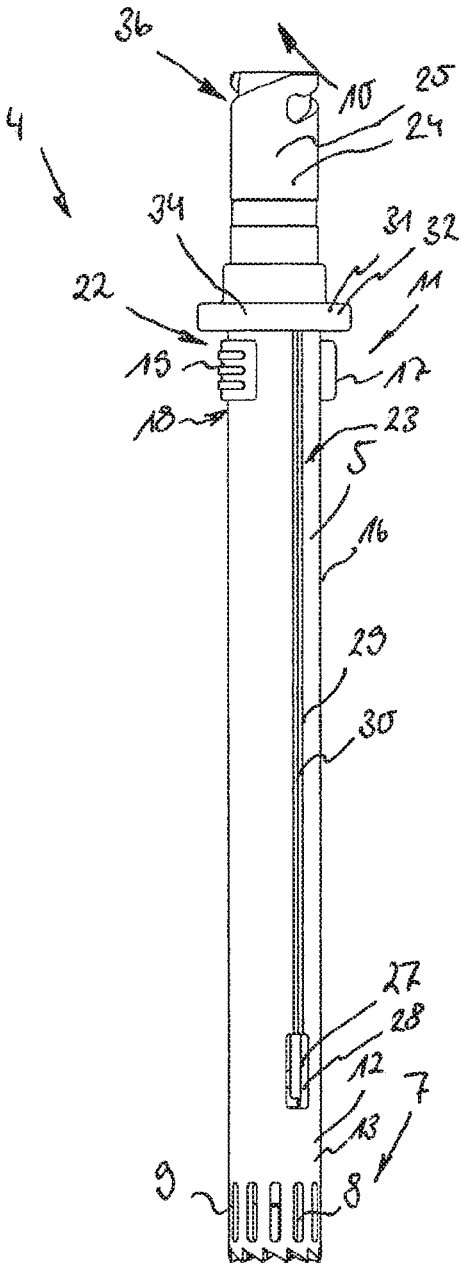
Figure 8:
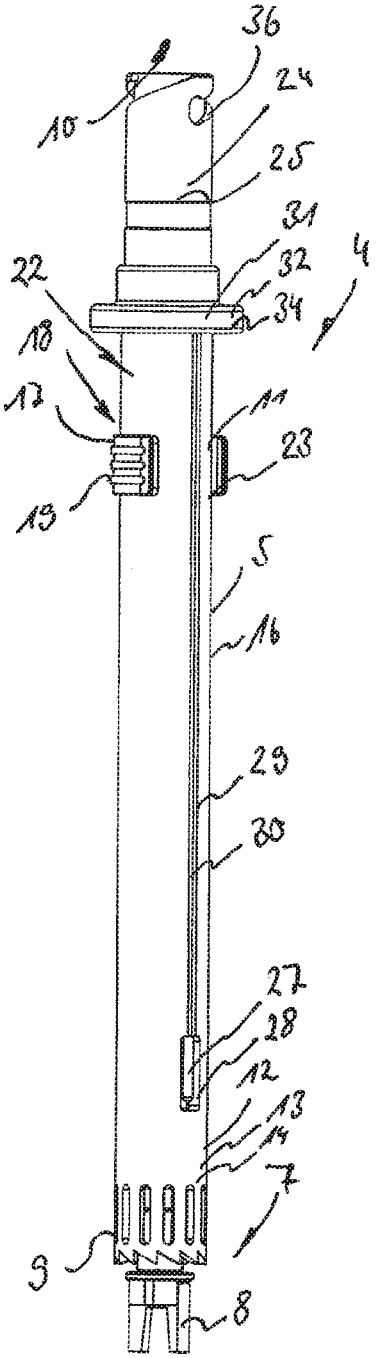
Figure 9:
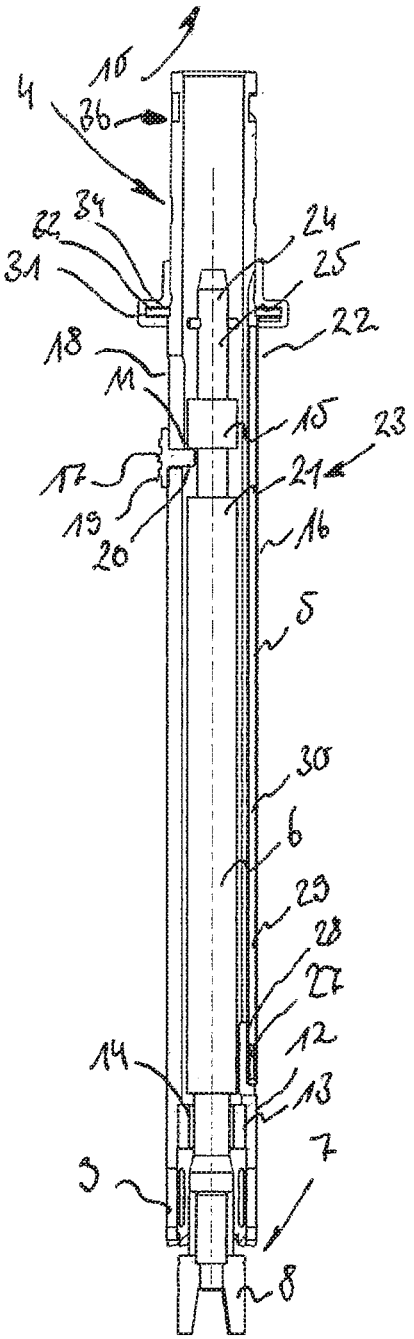
Figure 10:
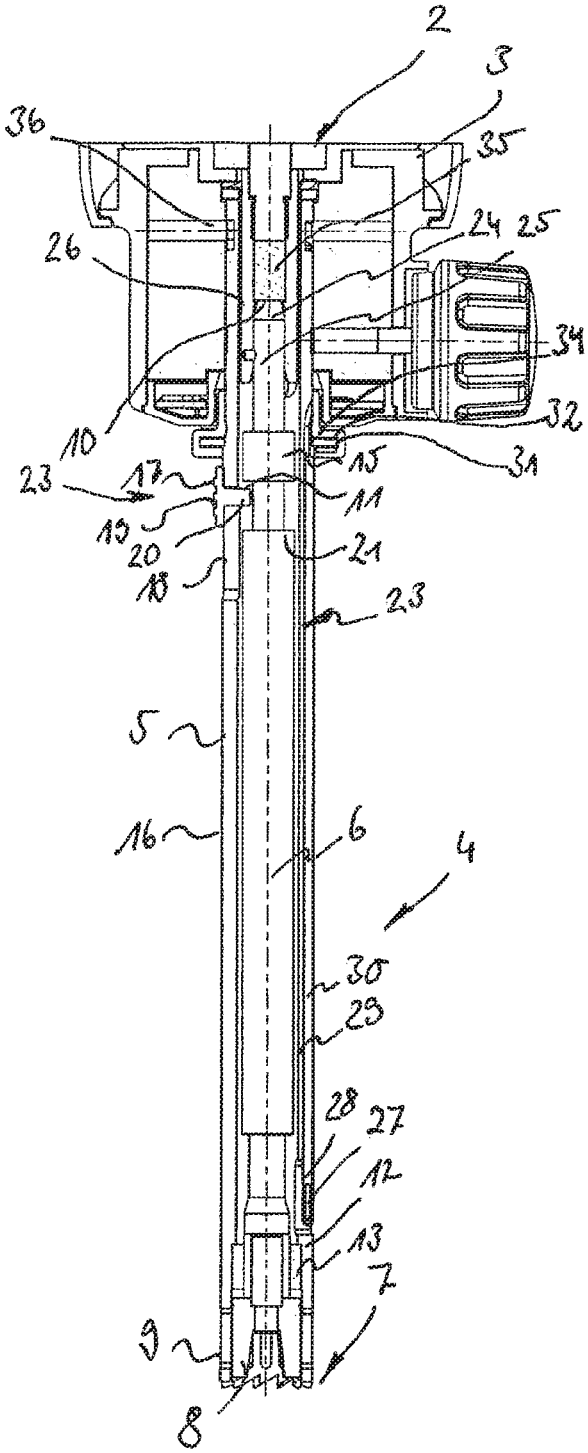

In the following text, an embodiment of the invention will be described in greater detail. The partly diagrammatic representation shows:

FIG. 1: a perspective side view of a dispersion device according to the invention, wherein a drive unit of the dispersion device and a dispersion tool according to the invention connected thereto are shown, FIG. 2: a side view of a dispersion tool according to the invention with a bayonet-style tool coupling on a power-unit side end of the dispersion tool and a stator on the free end of the dispersion tool opposite the power unit side, wherein a dispersion rotor and a rotor shaft of the dispersion tool are shown in their working position inside a shaft tube of the dispersion tool, FIG. 3: the dispersion tool according to the invention represented in FIG. 2 with the dispersion rotor and the rotor shaft in the cleaning position, FIG. 4: a cutaway side view of the dispersion tool according to the invention represented in FIGS. 2 and 3, FIG. 5: a cutaway side view of the dispersion device according to the invention represented in FIG. 1, FIG. 6: a perspective side view of the dispersion device represented in FIG. 1 with a further dispersion tool according to the invention, with a temperature sensor arranged on the outside thereof, FIG. 7: a side view of the dispersion tool according to the invention represented in FIG. 6, wherein a dispersion rotor of the dispersion tool is represented in working position inside the shaft tube of the dispersion tool, FIG. 8: the dispersion tool according to the invention represented in FIGS. 6 and 7, wherein the dispersion rotor is represented in its cleaning position outside the shaft tube of the dispersion tool, FIG. 9: a cutaway side view of the dispersion tool according to the invention represented in FIGS. 6 to 8 with dispersion rotor in the cleaning position, and FIG. 10: a cutaway partial view of the dispersion device according to the invention represented in FIG. 6 with a dispersion tool equipped with a temperature sensor.

FIGS. 1 and 6 show a dispersion device designated as a whole with 1, with a drive unit 3 having a power unit 2 and with a dispersion tool 4.

FIGS. 2 to 5 and 7 to 10 show detailed views of various embodiments of two dispersion tools 4 according to the invention.

In the following description of the various embodiments of the dispersion tool 4 according to the invention, elements with equivalent function are denoted with the same reference numerals even if the structure or shape thereof is different.

Each of the dispersion tools 4 represented is equipped with one shaft tube 5 and one rotor shaft 6 mounted so as to be rotatable in shaft tube 5. A dispersion rotor 8 is arranged on a free end 7 of dispersion tool 4 farthest from power unit 2 in the operating position, which rotor is drivable with the aid of rotor shaft 6 and is at least partly surrounded by shaft tube 5. While dispersion tool 4 is in operation, said dispersion rotor 8 rotates relative to a stator 9 constructed in fixed manner on shaft tube 5. As the figures show, stator 9 is slotted, so that dispersed medium is able to enter and exit through it.

A comparison of FIGS. 2 to 5 and FIGS. 7 to 10 reveals that dispersion rotor 8 is arranged on dispersion tool 4 so as to be displaceable axially between a working position inside the shaft tube (see FIGS. 2 and 5 and FIGS. 7 and 10) and a cleaning position outside shaft tube 5 (see FIGS. 3 and 4 and FIGS. 8 and 9).

The cutaway representations of FIGS. 4 and 5 and 9 and 10 reveal that dispersion rotor 8 is mounted so as to be displaceable together with rotor shaft 6 axially inside shaft tube 5 between a working limit stop 10 that defines the working position of dispersion rotor 8 and cleaning limit stop 11 that defines the cleaning position of dispersion rotor 8.

All cutaway representations of dispersion tool 4 also show that dispersion rotor 8 is mounted so as to be rotatable together with rotor shaft 6 inside shaft tube 5 of dispersion tube 6 by means of a radial bearing 12, which in the embodiments of dispersion tool 4 shown in the figures has the form of a ceramic radial plain bearing.

In this context, a distance between the working position and the cleaning position and an axial advance of dispersion rotor 8 and rotor shaft 6 from the working position into the cleaning position is at least as large as an axial dimension of radial bearing 12. When dispersion rotor 8 has been displaced into the cleaning position, a flushing gap 14 is present between a bearing outer surface 13 of radial bearing 12 and rotor shaft 6, which gap facilitates cleaning of dispersion tool 4. Shaft tube 5 further has two openings, which serve as flushing openings 14*a* during cleaning of the dispersion tool and through which the cleaning means and/or cleaning fluid can enter shaft tube 5.

The figures also show that cleaning limit stop 11 is formed inside shaft tube 5, and that rotor shaft 6 has a shaft shoulder 15 which is constructed to match cleaning limit stop 11, wherein an internal diameter of shaft tube 5 delimited by cleaning limit stop 11 is smaller than an external diameter of shaft shoulder 15. At the same time, a distance between dispersion rotor 8 and shaft shoulder 15 of rotor shaft 6 is larger than a distance between free end 7 of shaft tube 5 and cleaning limit stop 11, at when said stop is arranged in its position assigned to the cleaning position of dispersion rotor 8. This is represented in FIGS. 3, 4, 8 and 9.

Dispersion tool 4 is equipped with an actuating element 17 arranged on an outer side 16 of shaft tube 5, which is connected to dispersion rotor 8 and rotor shaft 6 in such manner that dispersion rotor 8 is displaceable together with rotor shaft 6 between the working position and the cleaning position by means of actuating element 17.

Actuating element 17 comprises a slider 19 guided in a slot 18 that is arranged and extends axially in shaft tube 5. Slider 19 includes a pin 20 which protrudes through slot 18 and into shaft tube 5, and clasps behind at least one pin shaft shoulder 21 of rotor shaft 6 to move the dispersion rotor 8 between the working position and the cleaning position in at least one direction of movement of dispersion rotor 8 and rotor shaft 6. It is evident particularly from the cutaway representations of the dispersion tools 4 that the cleaning limit stop 11 in the present embodiments according to the invention of dispersion tools 4 is formed on actuating element 17 and in particular on the pin 20 of actuating element 17 which protrudes into shaft tube 5. In conjunction with shaft shoulder 15, pin 20 prevents rotor shaft 6 from being pulled completely out of shaft tube 5.

Actuating element 17 may be displaced in the longitudinal direction of shaft tube 5 between a first detent point 22 associated with the working position of dispersion rotor 8 and a second detent point 23 associated with the cleaning position of dispersion rotor 8 on shaft tube 5. The figures further show that an axial dimension of the slot 18 is as least as large as a distance between the working position and the cleaning position of dispersion rotor 8.

Another embodiment of actuating element 17, which is not represented in the figures but also falls within the scope of the invention provides that actuating element 17 includes or comprises a magnetic coupling element. Actuating element 17 is connected to dispersion rotor 8 and/or rotor shaft 6 magnetically via this magnetic coupling element. In this context, it is also possible to speak of a magnetic coupling between actuating element 17 and dispersion rotor 8 and/or rotor shaft 6. The magnetic coupling between actuating element 17 and dispersion rotor 8 and/or rotor shaft 6 is of such a kind that and/or rotor shaft 6 may be displaced between the working position and the cleaning position by a displacement of actuating element 17.

In such a case, the magnetic coupling element of actuating element 17 comprises at least one magnet. The magnet may have the form of a permanent magnet, for example, or it may also be an electromagnet. Dispersion rotor 8 and/or rotor shaft 6 are equipped with a countercoupling element, with which the magnet of the coupling element is or may be magnetically coupled to transmit a displacement movement of actuating element 17 to the dispersion rotor 8 and/or rotor shaft 6. The transmission of the movement of actuating element 17 via the magnetic coupling to dispersion rotor 8 and/or rotor shaft 6 may cause dispersion rotor 8 and/or rotor shaft 6 to be displaced between the working position and the cleaning position.

Rotor shaft 6 of dispersion tool 4 is equipped with a coupling 25 on an end 24 on the power unit side of dispersion tool 4 closest to the drive unit 3 in the operating position for detachable connection with drive unit 3 of dispersion device 1 and for transmitting torques from drive unit 3 to rotor shaft 6. Said coupling 25 is designed to be compatible with a countercoupling 26 provided on drive unit 3.

The power-unit side end 24 of rotor shaft 6 of dispersion tool 4 farthest from dispersion rotor 8 is magnetic and/or ferromagnetic. In such case, it may be provided for example that at this point rotor shaft 6 is made from a ferromagnetic material, ferromagnetic stainless steel for example, or has a ferromagnetic material coating.

In the embodiments of the dispersion tool represented in FIGS. 6 to 10, it is provided that at least one sensor 27 is arranged on the dispersion tool 4, specifically adjacent to the free end 7 of shaft tube 5. In the embodiment of the dispersion tool represented in FIGS. 6 to 10, said sensor 27 is a temperature sensor. In other embodiments of dispersion tool 4 which are not represented in the figures, it is provided that dispersion tool 4 is equipped with a PH-value sensor and/or a pressure sensor or other sensors of such kind instead of a temperature sensor.

It is further evident from FIGS. 6 to 10 that the sensor 27 in the form of a temperature sensor here is recessed into a depression 28 on the outer side 16 of shaft tube 5. A sensor connection 30 on the outer side 16 of shaft tube 5 is arranged to extend in a groove 29 starting from sensor 27 towards the power-unit side end 24 of shaft tube 5 of dispersion tool 4.

This sensor connection 30 may be realized for example in the form of a cable or also in the form of an electrically conductive coating. In the context of this Application, the term sensor connection is understood to mean any means that allows a transmission of information from sensor 27 to the power-unit side end 24 of dispersion tool 4, or also to drive unit 3 of dispersion device 1. Thus, the sensor connection 30 is explicitly not limited to a cable-based connection between sensor 27 and the power-unit side end 24 of dispersion tool 4 or between sensor 27 and drive unit 3 of the dispersion device.

All of the dispersion tools 4 represented in the figures are equipped with a writable transponder 31, which is in the form of a RFID chip, for example, and comprises a data memory 32. Data memory 32 may be used to store specific dispersion tool data, for example operating data such as permissible rotating speeds for the dispersion tool 4, data received from the at least one sensor 27 of dispersion tool 4, and data transmitted to transponder 31 by a transmitter/receiver unit 33 of drive unit 3 of dispersion device 1.

Sensor 27 is connectible and in the operating position connected to drive unit 3 of dispersion device 1 in order to transmit measurement data. It is further provided that sensor 27, is connectible or connected, in particular connected by cable, to transponder 31. In this case, the connecting means is sensor connection 30.

In the present embodiments, it is provided that transponder 31 is equipped with an electronic evaluation unit 34 for processing measurement data received from the at least one sensor 27 and is configured for wireless transmission of measurement data to drive unit 3 of dispersion device 1, in particular to transmitter/receiver unit 33. Dispersion tool 4 is detachably connectible to dispersion device 1 and is connected in the operating position.

Dispersion tool 4 or at least elements of dispersion tool 4 that come into contact with the medium that is to be dispersed during use of the dispersion tool 4, that is to say at least the dispersion rotor 8 and at least parts of rotor shaft 6 and stator 9 of dispersion tool 1, may be provided with a non-stick coating if necessary. The purpose of this coating is to prevent the adhesion of dirt particles or at least make it more difficult. In this way, dirt particles may be removed from said elements or parts of dispersion tool 4 more easily, thereby improving the cleanability of dispersion tool 4. Accordingly, such coatings may also be referred to as easy-to-clean coatings. Suitable coatings in this context may consist of carbon and/or amorphous carbon and/or diamantine carbon and/or diamond-like-carbon (DLC). It is further provided that at least particularly heavily exposed parts of the dispersion tool 4, such as the dispersion rotor 8, at least parts of the rotor shaft 6 or also the stator 9 are furnished with a coating that has greater hardness than uncoated stainless steel. Coatings that are suitable for are those with a hardness greater than 1000 HV (Vickers hardness). This results in increased stability of the dispersion tool and may also improve the chemical resistance of the parts of the dispersion tool 4 that are provided with such a coating. It is also conceivable to furnish dispersion tool 4 with diamond coatings, which not only maximize the surface hardness of the coated parts but may also maximize the resistance to wear of the parts of dispersion tool 4 that are provided with such a coating.

As was noted previously, dispersion device 1 is equipped with a countercoupling 26 constructed to be compatible with the coupling 25 of dispersion tool 4, via which turning torques may be transmitted from power unit 2 of drive unit to rotor shaft 6.

Drive unit 3 of dispersion device 1 has a permanent magnet 35 on the countercoupling 26 of drive unit 3 for rotor shaft 6 to create a magnetic coupling between drive unit 3 and rotor shaft 6. The magnetic power-unit side end 24 of rotor shaft 6 is magnetically coupled to said permanent magnet 35 and connected therewith in the operating position. Consequently, a separate axial bearing of rotor shaft 6 such as is usual in the dispersion tools 4 known from the prior art may be dispensed with.

A bayonet-style tool coupling 36 is provided between dispersion tool 4 and drive unit 3 of dispersion device 1 for detachably connecting dispersion tool 4 to drive unit 3.

In this context, a vertex between a longitudinal slot and a transverse slot of a guide for bayonet-style tool coupling 36 is arranged or constructed in such manner that the magnetic power-unit side end 24 of rotor shaft 6 in the operating position approaches close enough to the permanent magnet 35 of drive unit 3, to enable the magnetic coupling to be created between drive unit 3 and rotor shaft 6 automatically when the bayonet-style tool coupling 36 is closed.

As was noted previously, dispersion device 1, and here in particular drive unit 3 has a transmitter/receiver unit 33, which is configured to read from and write to transponder 31 of dispersion tool 4. In this way, drive unit 3 of the dispersion device is configured to identify dispersion tool 4 by means of data that is or can be stored on transponder 31. Drive unit 3 is also equipped with a control and/or regulating unit 37 which is connected to both the power unit 2 and the transmitter/receiver unit 33, and with which the power unit 2 may be controlled and/or regulated on the basis of the data transmitted by the transmitter/receiver unit 33 to the control and/or regulating unit 37.

In an embodiment of dispersion device 1 not represented in the figures, it is provided that dispersion device 1 has a temperature control device for controlling the temperature of the medium that is to be dispersed, that is to say heating or cooling it, or is connectible and in the operating position connected with such a device. In such case, the temperature control device may also be controlled or regulated on the basis of data from the at least one sensor 27 transmitted by transponder 31, in particular via the control/regulating unit 37 of dispersion device 1.

A user interface 38 is provided on the drive unit 3 of dispersion device 1. Said user interface 38 has various displays and screens as well as operating elements, with which the drive unit 3 may be operated.

Together with at least two replaceable dispersion tools 4 according to the invention, dispersion device 1 forms a dispersion assembly according to the invention.

For the purpose of simplified cleaning of dispersion tool 4, it is herewith provided that dispersion rotor 8 is arranged on dispersion tool 4 so as to be displaceable axially between the working position located inside shaft tube 5 and the cleaning position located outside shaft tube 5, wherein dispersion rotor 8 is located preferably entirely outside shaft tube 5 in the cleaning position, and may thus be cleaned without difficulty.

The invention claimed is:

1. A dispersion tool (4) with a shaft tube (5) and a rotor shaft (6) rotatable in the shaft tube (5), wherein a dispersion rotor (8) is arranged on a free end (7) of the rotor shaft (6) such that the dispersion rotor (8) is drivable by the rotor shaft (6), wherein, the rotor shaft (6) is axially displaceable relative to the shaft tube (5) to displace the dispersion rotor (8) between a working position located inside the shaft tube (5) and a cleaning position located outside the shaft tube (5) wherein, a radial bearing (12) is located between the rotor shaft (6) and the shaft tube (5), and, wherein, the rotor shaft (6) has a reduced-diameter section which is axially aligned with the radial bearing (12), with the dispersing rotor (8) being in the cleaning position, to define a flushing gap (14) between the reduced-diameter section of the rotor shaft (6) and the radial bearing (12).

2. The dispersion tool (4) according to claim 1, wherein, the dispersion tool (1) has a cleaning limit stop (11) that defines the cleaning position of the dispersion rotor (8).

3. The dispersion tool (4) according to claim 2, wherein, at least one of the dispersion rotor (4) and the rotor shaft (6) are mounted inside the shaft tube (5) so as to be axially displaceable between a working limit stop (10) that defines the working position of the dispersion rotor (4) and the cleaning limit stop (11) that defines the cleaning position of the dispersion rotor (4).

4. The dispersion tool (4) according to claim 2, wherein, the cleaning limit stop (11) is formed inside the shaft tube (5) and that the rotor shaft (6) has a shaft shoulder (15) constructed to be compatible with the cleaning limit stop (11), wherein an internal diameter of the shaft tube (5) defined by the cleaning limit stop (11) is smaller than an external diameter of the shaft shoulder (15).

5. The dispersion tool (4) according to claim 4, wherein, a distance between the dispersion rotor (8) and the shaft shoulder (15) of the rotor shaft (6) is at least as large as a distance between a free end of the shaft tube (5) and the cleaning limit stop (11).

6. The dispersion tool (4) according to claim 1, wherein, the distance between the working position and the cleaning position of the dispersion rotor (8) is at least as large as an axial dimension of the radial bearing (12).

7. The dispersion tool (4) according to claim 1, wherein, the dispersion tool (4) has an actuating element (17) arranged on an outer side (16) of the shaft tube (5), which is connected to at least one of the dispersion rotor (8) and the rotor shaft (6) in such manner that the dispersion rotor (8) is axially displaceable between the working position and the cleaning position relative to the shaft tube (5) by means of the actuating element (17).

8. The dispersion tool (4) according to claim 7, wherein, the actuating element (17) comprises a slider (19) which is guided in a slot (18) that is arranged and extends in axial direction in the shaft tube (5), and, wherein the slider (19) has a pin (20) which protrudes through the slot (18) and into the shaft tube (5), such that the pin clasps behind at least one pin shaft shoulder (21) of the rotor shaft (6) to axially displace the dispersion rotor (8) between the working position and the cleaning position relative to the shaft tube (5).

9. The dispersion tool (4) according to claim 8, wherein, an axial dimension of the slot (18) is at least as large as a distance between the working position and the cleaning position of the dispersion rotor (8).

10. The dispersion tool (4) according to claim 7, wherein, the actuating element (17) has a magnetic coupling element such that a movement of the actuating element (17) causes the rotor shaft (6) to be magnetically coupled to the magnetic coupling element in the working position.

11. The dispersion tool (4) according to claim 10, wherein, the magnetic coupling element includes at least one magnet, and the rotor shaft (6) has/have has a countercoupling element with which the magnet of the coupling element can be magnetically coupled.

12. The dispersion tool (4) according to claim 7, wherein, the actuating element (17) is displaceable on the shaft tube (5) between a first detent point (22) associated with the working position of the dispersion rotor (8) and a second detent point (23) associated with the cleaning position of the dispersion rotor (8).

13. The dispersion tool (4) according to claim 1, wherein, the rotor shaft (6) is equipped with a coupling (25) on a power-unit side end (24) of the dispersion tool (4) for detachable connection with a drive unit (3) of a dispersion device (1) for transmitting torques from a drive unit (3) to the rotor shaft (6), wherein the coupling (25) is constructed to be compatible with a countercoupling (26) formed on the drive unit (3).

14. The dispersion tool (4) according to claim 13, wherein, the power-unit side end (24) of the rotor shaft (6) of the dispersion tool (4) contains a ferromagnetic material.

15. The dispersion tool (4) according to claim 1, wherein, at least one sensor (27) is arranged on the dispersion tool (4).

16. The dispersion tool (4) according to claim 15, wherein, the dispersion tool (4) is equipped with a writable transponder (31), wherein the transponder (31) has a data memory (32) in which is stored at least one of: data specific to the dispersion tool, operating data of the dispersion tool (4), data received from the at least one sensor (27) of the dispersion tool (4), and data transmitted to the transponder (31) by a transmitter/receiver unit (33).

17. The dispersion tool (4) according to claim 15, wherein, the at least one sensor (27) is connected to a transponder (31), wherein the transponder (31) is equipped with an electronic evaluation unit (34) for processing measurement data received from the at least one sensor (27) and is configured for wirelessly transmitting measurement data to a drive unit (3) of a dispersion device (1).

18. The dispersion tool (4) according to claim 1, wherein, the dispersion tool (4) is at least partially furnished with a non-stick coating.

19. A dispersion device (1) comprising:

a drive unit (3) having a power unit (2); and a dispersion tool (4) mounted to the drive unit (3), the dispersion tool (4) including a shaft tube (5) and a rotor shaft (6) rotatable in the shaft tube (5), wherein a dispersion rotor (8) is arranged on a free end of the rotor shaft (6) such that the dispersion rotor (8) is drivable by the rotor shaft (6), wherein, the rotor shaft is axially displaceable relative to the shaft tube (5) to displace the dispersion rotor (8) between a working position located inside the shaft tube (5) and a cleaning position located outside the shaft tube (5), wherein, the drive unit (3) is equipped with a magnet (35) to create a magnetic coupling between the drive unit (3) and the rotor shaft (6) to allow turning torque from the power unit (2) to be transmitted to the rotor shaft (6).

20. The dispersion device (1) according to claim 19, wherein, a working limit stop (10) defining the working position of the dispersion rotor (8) is formed on the dispersion device (1).

21. The dispersion device (1) according to claim 19, wherein, a bayonet-style tool coupling (36) is provided between the dispersion tool (4) and the drive unit (3) for detachably connecting the dispersion tool (4) to the drive unit (3).

22. The dispersion device (1) according to claim 21, wherein, a vertex is arranged for formed between a lengthwise slot and a transverse slot of a guide for the bayonet-style tool coupling (36) in such manner that a power-unit side end (24) of the rotor shaft (6) comes close enough to the magnet (35) of the drive unit (3) in the operating position so that the magnetic coupling can be created between the drive unit (3) and the rotor shaft (6) when the bayonet-style tool coupling (36) is closed.

23. The dispersion device (1) according to claim 19, wherein, the drive unit (3) is equipped with a transmitter/receiver unit (33) which is configured to read from and write to a transponder (31) of the dispersion tool (4).

24. The dispersion device (1) according to claim 23, wherein, the drive unit (3) is equipped with a control regulating unit (37) that is connected to the power unit (2) and to the transmitter/receiver unit (33), with which the power unit (2) can be controlled on the basis of data transmitted by the transmitter/receiver unit (33) to the control unit (37).

25. The dispersion device (1) according to claim 24, wherein, the dispersion device (1) is equipped with a temperature control device for controlling the temperature of a medium that is to be dispersed, wherein, the temperature control device is controlled by the control unit (37) of the dispersion device (1), on the basis of data transmitted by the transponder (31).

* * * * *